US007159944B1

(12) United States Patent
Tseng

(10) Patent No.: US 7,159,944 B1
(45) Date of Patent: Jan. 9, 2007

(54) BACKREST FOR A CHAIR

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 11/487,611

(22) Filed: Jul. 17, 2006

(51) Int. Cl.
*A47C 7/48* (2006.01)

(52) U.S. Cl. ..... 297/354.11; 297/452.38

(58) Field of Classification Search ..... 297/354.1, 297/354.11, 440.1, 440.15, 452.38
See application file for complete search history.

(56) References Cited

U.S. PATENT DOCUMENTS 2,114,920 A * 4/1938 Grabb ..... 297/354.11
2,577,089 A * 12/1951 Mondy ..... 297/354.11
5,277,475 A * 1/1994 Brandes ..... 297/354.11
5,683,142 A * 11/1997 Gunderson et al. .... 297/440.21
6,305,747 B1 * 10/2001 Mei ..... 297/440.2

* cited by examiner

*Primary Examiner*—Peter R. Brown
(74) *Attorney, Agent, or Firm*—Ladas & Parry LLP

(57) ABSTRACT

A backrest includes: a back support having a top end portion provided with a pivot shaft that has two opposite end portions; a backrest cushion having a rear wall formed with two threaded holes; a coupling cover having an open end, covering the pivot shaft, and having a back wall that is formed with two counter bores; two screw bolts extending respectively through the counter bores and engaging threadedly and respectively the threaded holes to permit abutment of the open end of the coupling cover against the rear wall of the backrest cushion; and two pivoting members, each having a pivot sleeve sleeved rotatably on a respective end portion of the pivot shaft, and a linkage extending from the pivot sleeve and coupled to a respective one of the screw bolts.

3 Claims, 5 Drawing Sheets

BACKREST FOR A CHAIR

BACKGROUND OF THE INVENTION

1. Field of the Invention

The invention relates to a backrest for a chair, more particularly to a backrest having a backrest cushion pivoted to a pivot shaft through a pair of pivoting members.

2. Description of the Related Art

A conventional chair, as shown in FIGS. 1 and 2, includes a seat member 11, a seat leg unit 12 disposed under a bottom of the seat member 11, and a backrest 2 extending upright from the seat member 11. The backrest 2 includes an L-shaped back support 21 having a top end portion provided with a rigid pivot shaft 213 that has two opposite end portions 214; a backrest cushion 22 disposed adjacent to the top end portion of the back support 21 and having a rear wall 221 that is formed with a pair of threaded holes 222; a coupling cover 23 made from a plastic material and having an open end 218 facing toward the rear wall 221 of the backrest cushion 22, covering the pivot shaft 213, and having a back wall 231 that is formed with a pair of counter bores 233; and a pair of screw bolts 24 extending respectively through the counter bores 233 in the back wall 231 of the coupling cover 23 and engaging threadedly and respectively the threaded holes 222 in the rear wall 221 of the backrest cushion 22 so as to drive the coupling cover 23 toward the backrest cushion 22 and to permit abutment of the open end 218 of the coupling cover 23 against the rear wall 221 of the backrest cushion 22. A pair of shaft-supporting plates 235 extend from the back wall 231 of the coupling cover 23, and are formed with end recesses 236 for receiving the end portions 214 of the pivot shaft 213, respectively.

When the chair 1 is in use, the user usually has his back abutting against the backrest cushion 22. When the user lying against the backrest cushion 22, the coupling cover 23, which engages the backrest cushion 22 through the bolts 24, will pivot about the pivot shaft 213 of the back support 21. The pivoting action will result in friction between the end portions 214 of the pivot shaft 213 and the shaft-receiving plates 235, which, in turn, can result in wearing of the shaft-receiving plates 235, thereby shortening the service life of the chair 1.

SUMMARY OF THE INVENTION

Therefore, the object of the present invention is to provide a backrest that can overcome the aforesaid drawback associated with the prior art.

Accordingly, a backrest of the present invention is applied to a chair and comprises: a back support having a top end portion provided with a pivot shaft that has two opposite end portions; a backrest cushion disposed adjacent to the top end portion of the back support and having a rear wall that is formed with a pair of threaded holes; a coupling cover having an open end facing toward the rear wall of the backrest cushion, covering the pivot shaft, and having a back wall that is formed with a pair of counter bores; a pair of screw bolts extending respectively through the counter bores in the back wall of the coupling cover and engaging threadedly and respectively the threaded holes in the rear wall of the backrest cushion so as to drive the coupling cover toward the backrest cushion and to permit abutment of the open end of the coupling cover against the rear wall of the backrest cushion; and a pair of pivoting members, each of which has a pivot sleeve that is sleeved rotatably on a respective one of the end portions of the pivot shaft, and a linkage that extends from the pivot sleeve and that is coupled to a respective one of the screw bolts so as to pivot the backrest cushion together with the coupling cover about the pivot shaft.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
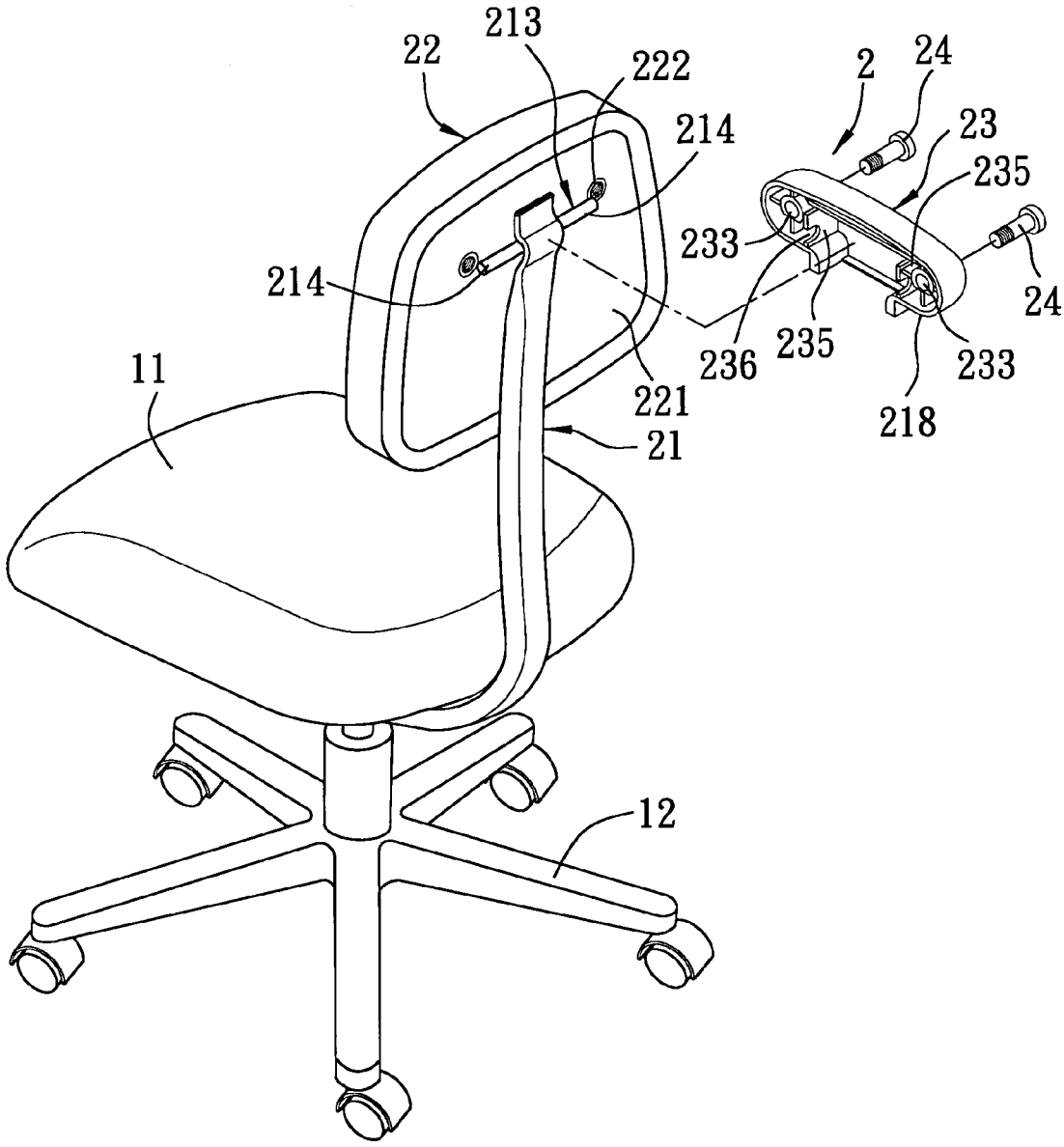
FIG. 1 PRIOR ART
FIG. 1 is a partly exploded perspective view showing a chair with a conventional backrest.
Figure 2:
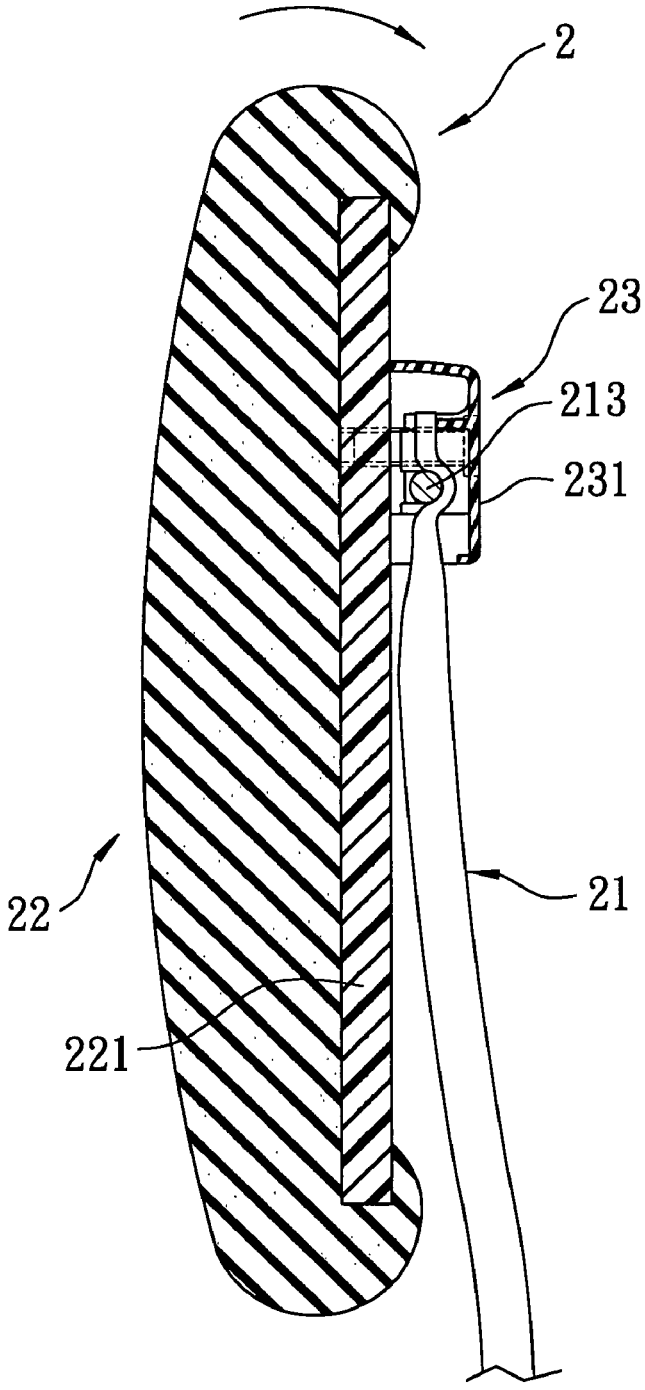
FIG. 2 PRIOR ART
FIG. 2 is a fragmentary assembled sectional view of the conventional backrest.
Figure 3:
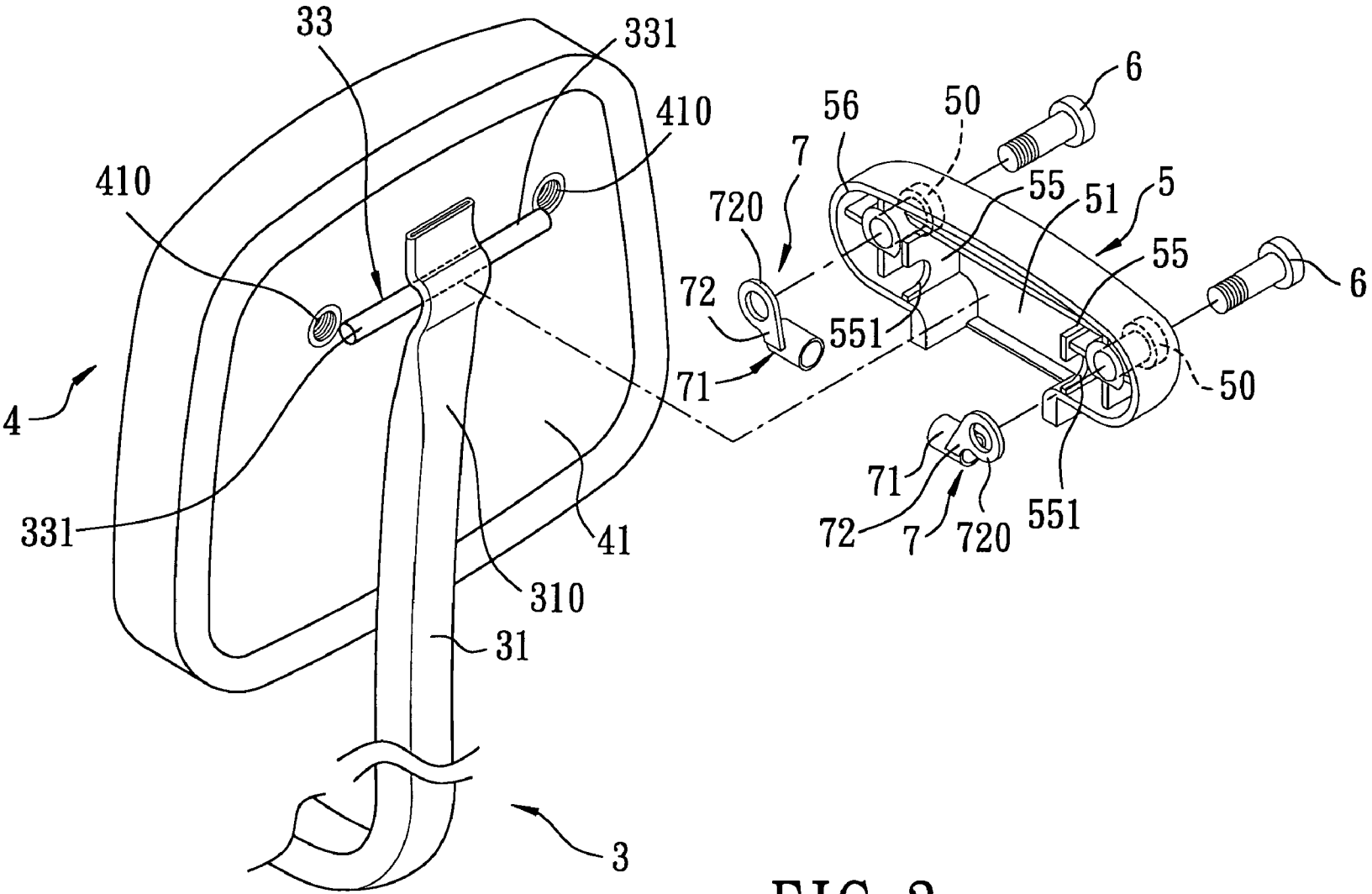
FIG. 3 is an exploded perspective view of the preferred embodiment of a backrest for a chair according to the present invention.
Figure 4:
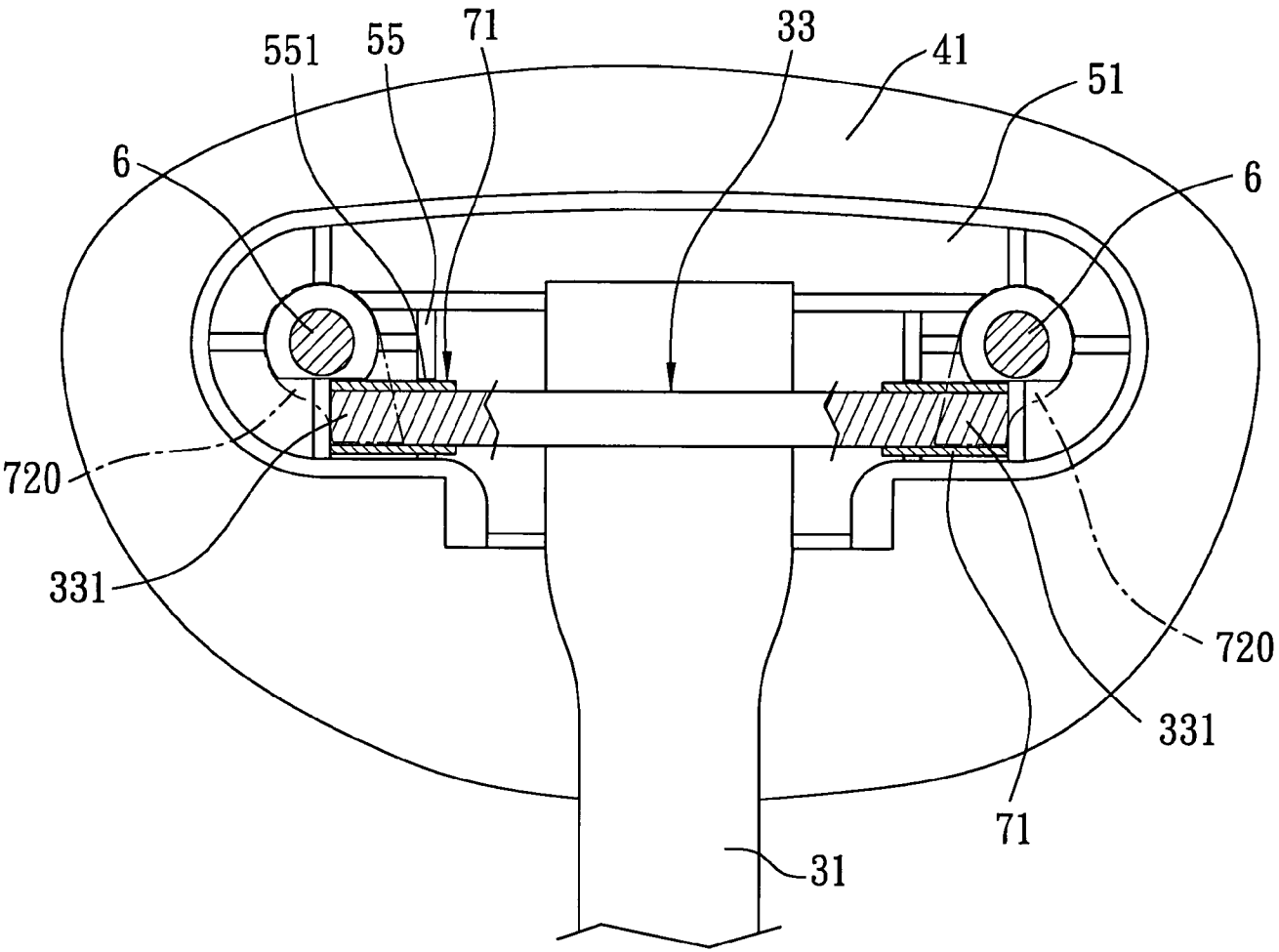
FIG. 4 is a fragmentary partly sectional view of the preferred embodiment.
Figure 5:
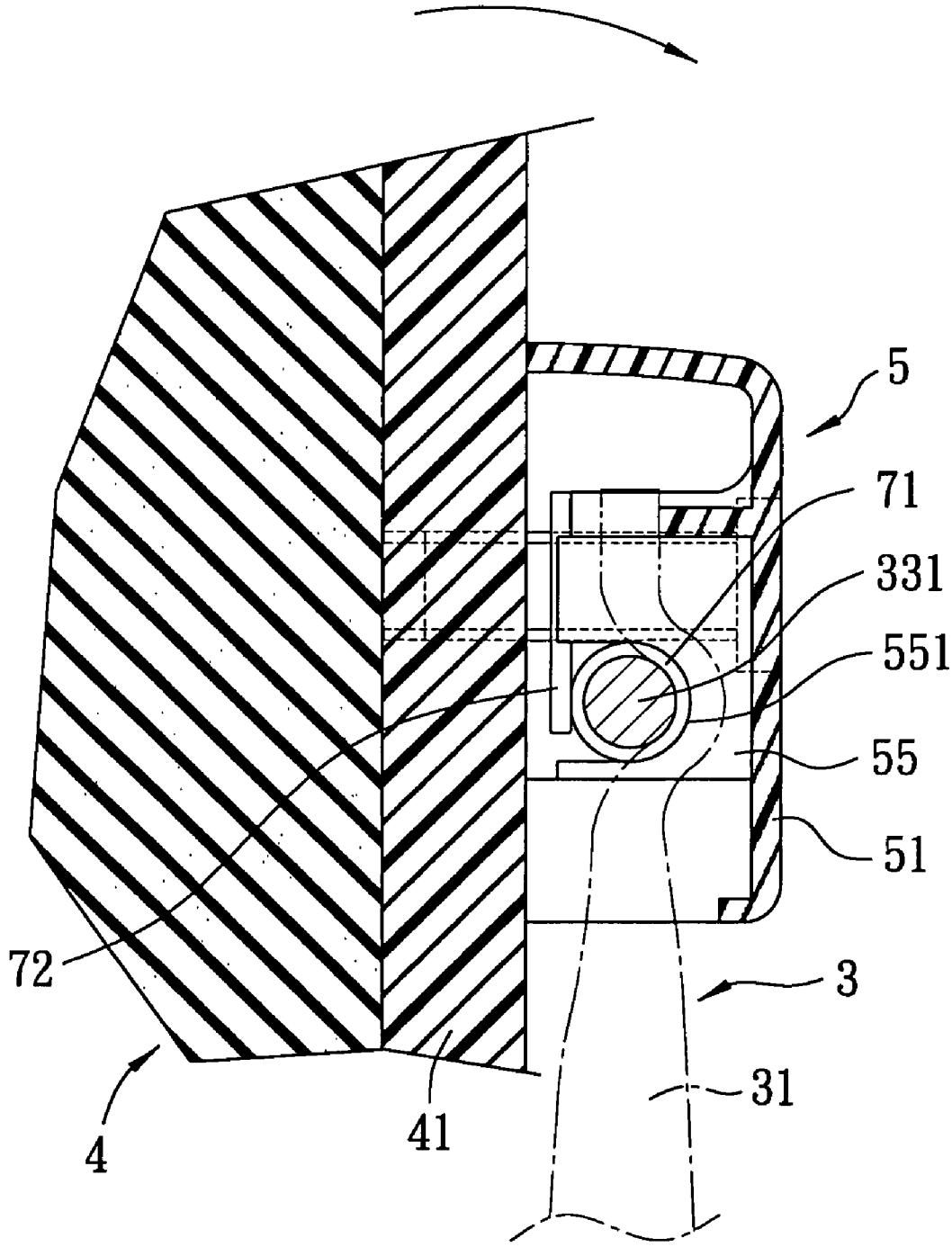
FIG. 5 is another fragmentary partly sectional view of the preferred embodiment.

Referring to FIGS. 3 to 5, the preferred embodiment of a backrest 3 according to the present invention is to be applied to a chair and is shown to include: a back support 31 having a top end portion 310 provided with a pivot shaft 33 that has two opposite end portions 331; a backrest cushion 4 disposed adjacent to the top end portion 310 of the back support 3 and having a rear wall 41 that is formed with a pair of threaded holes 410; a coupling cover 5 having an open end 56 facing toward the rear wall 41 of the backrest cushion 4, covering the pivot shaft 33, and having a back wall 51 that is formed with a pair of counter bores 50; a pair of screw bolts 6 extending respectively through the counter bores 50 in the back wall 51 of the coupling cover 5 and engaging threadedly and respectively the threaded holes 410 in the rear wall 41 of the backrest cushion 4 so as to drive the coupling cover 5 toward the backrest cushion 4 and to permit abutment of the open end 56 of the coupling cover 5 against the rear wall 41 of the backrest cushion 4; and a pair of pivoting members 7, each of which has a pivot sleeve 71 that is sleeved rotatably on a respective one of the end portions 331 of the pivot shaft 33, and a linkage 72 that extends from the pivot sleeve 71 and that is coupled to a respective one of the screw bolts 6 so as to pivot the backrest cushion 4 together with the coupling cover 5 about the pivot shaft 33.

In this embodiment, the pivoting members 7 are made from metal, and the linkage 72 has a free end formed with a ring-shaped plate 720 that is sleeved on the respective one of the screw bolts 6. When the coupling cover 5 together with the backrest cushion 4 is rotated rearward and downward, the screw bolts 6 are co-rotated therewith and push the ring-shaped plates 720 of the linkages 72 of the pivoting members 7 in the rotating direction to thereby rotate the pivoting members 7 about the pivot shaft 33.

Preferably, the coupling cover 5 is formed with a pair of sleeve-retaining plates 55 extending from the back wall 51 of the coupling cover 5 and formed with end recesses 551 for receiving the pivot sleeves 71 therein, respectively.

In use, when the user leans against the backrest cushion 4, the backrest cushion 4 together with the coupling cover 5 will pivot about the pivot shaft 33 of the back support 3. Since the pivot sleeves 71 of the pivoting members 7 are respectively sleeved on the end portions 331 of the pivot shaft 33, and since the pivot sleeves 71 co-rotate with the backrest cushion 4, friction between the pivot shaft 33 and the sleeve-retaining plates 55 during pivoting action of the backrest cushion 4 is avoided, thereby eliminating the aforesaid drawback associated with the prior art.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A backrest for a chair, comprising:

a back support having a top end portion provided with a pivot shaft that has two opposite end portions;

a backrest cushion disposed adjacent to said top end portion of said back support and having a rear wall that is formed with a pair of threaded holes;

a coupling cover having an open end facing toward said rear wall of said backrest cushion, covering said pivot shaft, and having a back wall that is formed with a pair of counter bores;

a pair of screw bolts extending respectively through said counter bores in said back wall of said coupling cover and engaging threadedly and respectively said threaded holes in said rear wall of said backrest cushion so as to drive said coupling cover toward said backrest cushion and to permit abutment of said open end of said coupling cover against said rear wall of said backrest cushion; and a pair of pivoting members, each of which has a pivot sleeve that is sleeved rotatably on a respective one of said end portions of said pivot shaft, and a linkage that extends from said pivot sleeve and that is coupled to a respective one of said screw bolts so as to pivot said backrest cushion together with said coupling cover about said pivot shaft.

2. The backrest as claimed in claim 1, wherein said linkage has one end formed with a ring-shaped plate that is sleeved on the respective one of said screw bolts.

3. The backrest as claimed in claim 2, wherein said coupling cover is formed with a pair of sleeve-retaining plate extending from said back wall of said coupling cover and formed with end recesses for receiving said pivot sleeves therein, respectively.

* * * * *